US008289273B2

(12) United States Patent
Yamazaki

(10) Patent No.: US 8,289,273 B2
(45) Date of Patent: Oct. 16, 2012

(54) SCAN LINE DRIVING CIRCUIT, ELECTRO-OPTICAL DEVICE, AND ELECTRONIC APPARATUS

(75) Inventor: Katsunori Yamazaki, Matsumoto (JP)

(73) Assignee: Sony Corporation, Tokyo (JP)

( * ) Notice: Subject to any disclaimer, the term of this patent is extended or adjusted under 35 U.S.C. 154(b) by 1162 days.

(21) Appl. No.: 12/137,142

(22) Filed: Jun. 11, 2008

(65) Prior Publication Data

US 2009/0033641 A1 Feb. 5, 2009

(30) Foreign Application Priority Data

Aug. 1, 2007 (JP) ..... 2007-200438

(51) Int. Cl.
*G09G 3/36* (2006.01)

(52) U.S. Cl. ..... 345/103; 345/100; 345/204

(58) Field of Classification Search ..... 345/204, 345/100, 103
See application file for complete search history.

(56) References Cited

U.S. PATENT DOCUMENTS

| | | | | |
|---|---|---|---|---|
| 7,425,940 | B2 * | 9/2008 | Kawachi | 345/98 |
| 7,515,121 | B2 * | 4/2009 | Sato et al. | 345/76 |
| 7,855,706 | B2 * | 12/2010 | Ozawa | 345/89 |
| 7,855,710 | B2 * | 12/2010 | Ito | 345/103 |
| 7,903,072 | B2 * | 3/2011 | Yamazaki | 345/98 |
| 2003/0103022 | A1 * | 6/2003 | Noguchi et al. | 345/77 |
| 2006/0016964 | A1 | 1/2006 | Ogawa | |
| 2006/0164380 | A1 * | 7/2006 | Yang et al. | 345/103 |
| 2006/0256066 | A1 * | 11/2006 | Moon | 345/100 |

FOREIGN PATENT DOCUMENTS

| | | |
|---|---|---|
| JP | A-9-232620 | 9/1997 |
| JP | A-2002-169518 | 6/2002 |
| JP | A-2006-29832 | 2/2006 |

* cited by examiner

*Primary Examiner* — Quan-Zhen Wang
*Assistant Examiner* — Michael J Eurice
(74) *Attorney, Agent, or Firm* — K&L Gates LLP

(57) ABSTRACT

Each scan line 112 has a unit circuit 40 that has TFTs 62,64 and 66. Capacitance C1 is short-circuited by the TFTs. Reset signal Rst is supplied to the gate electrode of TFT 62. the source electrode of TFT 62 is connected to a gate-on power supply line Vgon. The gate electrode of TFT 66 is connected to the drain electrodes of TFT 62 and 64, and the drain electrode of TFT 66 is connected to the gate electrode of TFT 42. The source electrodes of TFT 64 and 66 are connected to their own scan lines 112.

14 Claims, 9 Drawing Sheets

SCAN LINE DRIVING CIRCUIT, ELECTRO-OPTICAL DEVICE, AND ELECTRONIC APPARATUS

BACKGROUND

1. Technical Field

The present invention relates to a technique of driving scan lines using a multiplexer.

2. Related Art

As for electro-optical devices, such as liquid crystal devices (LCDs), pixels are disposed at every intersection of a plurality of scan lines and a plurality of data lines. Each of the pixels becomes the gray-scale according to the voltage (or current) of the corresponding data line when the corresponding scan line is set to an active level (for example, H level), and maintains the gray-scale even after the corresponding scan line becomes a non-active level (it is L level if the active level is an H level). Therefore, it is possible to display a target picture by activating a plurality of scan lines to an active level in predetermined turn and supplying a voltage (or current) corresponding to the gray-scale to the pixels associated with the activated scan lines having an active level via the data lines.

Here, a circuit which activates the plurality of scan lines in the predetermined turn so that the scan lines have an active level is called a scan line driving circuit and generally a shift register is used as the scan line driving circuit. As for such a scan line driving circuit, it is preferable that the scan line driving circuit is made into a peripheral circuit built-in type in which the scan line driving circuit is implemented with a switching element such as the pixel rather than the scan line driving circuit is implemented by mounting an external integrated circuit from the viewpoint of improvement in the manufacturing efficiency which can be resulted from harmonization of a process.

By the way, although a shift register has a complementary type logical circuit (an inverter or a clocked inverter) which is the combination of a p-channel type transistor and an n-channel type transistor, if electrical properties of the p-channel type transistor and the n-channel type transistor are not harmonized, there is a trouble in that penetration current flows. For such a reason, JP-A-2002-169518 discloses a so-called demultiplexer system in which a plurality of scan lines is grouped into a plurality of blocks, each including a predetermined number of rows of scan lines (for example, three lines), transistors TFT are provided to the scan lines, respectively as a switch, the blocks are selected one by one by address signals, the switches of the plurality of scan lines in one selected block are turned on one by one in turn by a select signal, and the scan lines are activated in turn to have an active level.

However, the known technique disclosed in JP-A-2002-169518 has a problem in that a voltage higher than the active level of the scan lines by a threshold voltage or more of the transistor serving as the switch must be applied to a gate electrode of the transistor in order to turn on the transistors disposed at the scan lines. Accordingly, with the technique, it is necessary to generate a voltage higher than the active level separately, which leads to the increase of a breakdown voltage of a power supply circuit which generates such voltage, and the increase in complexity of the structure.

SUMMARY

An advantage of some aspects of the invention is that it provides an electro-optical device, a scan line driving circuit, and an electro-optical apparatus, in which it is not necessary to generate a high voltage higher than an active level when driving the scan lines by using a demultiplexer system.

According to one aspect of the invention, there is provided a scan line driving circuit used in an electro-optical device having a plurality rows of scan lines grouped into a plurality of blocks, each block having p rows of scan lines (p is an integer which is two or more), a plurality columns of data lines, pixels which are disposed at every intersection between the plurality rows of scan lines and the plurality columns of data lines and which become gray-scale images corresponding to data signals supplied to the data lines when a logical level of the san line becomes an active level, the scan line driving circuit changing the logical level of selected scan lines to an active level by selecting the plurality rows of scan lines in a predetermined order, and including unit circuits corresponding to the plurality rows of scan lines, respectively, in which p unit circuits of all of the unit circuits, which correspond to the p rows of scan lines grouped in one block, are applied commonly with a logical signal during a period in which each of the scan lines corresponding to the p rows is selected, in which the each of the unit circuits includes a first transistor having a source electrode to which the logical signal is supplied and a drain electrode connected to the corresponding san line, a second transistor having a gate electrode to which a first control is supplied, a source electrode to which a second control signal is supplied, and a drain electrode connected to a gate electrode of the first transistor, and a short-circuiting circuit which causes a short-circuited state to a parasitic capacitor of the first transistor.

With such a structure, it is possible to self-generate a voltage of the gate electrode of the first transistor by using an active level and a non-active level. Accordingly, it becomes unnecessary to generate any voltage other than an active level and a non-active level when driving the scan lines. As a result, it is unnecessary to additionally install a special high breakdown voltage drive or a power supply outside the circuit, and it is possible to simplify the structure.

Further, by preparing the short-circuiting circuit which makes a parasitic capacitor of the first transistor fall into a short-circuit state, in the case in which the logical signal changes from a non-active level to an active level after only the first control signal becomes an active level, it is possible to prevent the first transistor from being in a half-ON state attributable to the change of the gate electrode of the first transistor, which is caused by the influence of the parasitic capacitor, and further it is possible to achieve improvement in display quality by preventing the off-leak current of the transistor TFT in the pixel, resulting from being in the half-ON state, from flowing.

In the scan line driving circuit, it is preferable that the short-circuiting circuit includes a third, a fourth, and a fifth transistor, in which the third transistor has a gate electrode to which a third control signal is supplied and a source connected to an active level, the fourth transistor has a gate electrode connected to the gate electrode of the first transistor, the fifth transistor has a gate electrode which is connected to both drain electrodes of the third and fourth transistors and a drain electrode connected to the gate electrode of the first transistor, and the source electrodes of the fourth and fifth transistors are connected to a non-active level.

With such a structure, the fifth transistor becomes an ON state by supplying the third control signal used as an active level to the third transistor, the parasitic capacitor between the gate and drain electrodes of the first transistor can be short-circuited. Moreover, in the case in which the first and second control signals become an active level after the third control signal is changed from an active level to a non-active level, the fourth transistor is turned on. As a result, since the fifth transistor can be turned off, the short-circuit state of the parasitic capacitor can be canceled.

Moreover, since the fourth transistor can be maintained in the OFF state and the short-circuit state of the parasitic capacitor can be maintained when only the first control signal is made into an active level after the third control signal is changed from an active level to a non-active level, even if a logical signal serves as an active level after that, it is possible to prevent the rise of the gate electrode voltage of the first transistor. In this manner, it is possible to constitute the short-circuiting circuit with a comparatively simple circuit structure.

In the scan line driving circuit, it is preferable that the source electrode of the third transistor is connected to a gate-on power supply line which supplies a gate-on voltage.

With such a structure, it is possible to make the fifth transistor fall into ON state when the third control signal serving as an active level is supplied to the third transistor.

In the scan line driving circuit, it is preferable that the source electrode of the third transistor is connected to the gate electrode thereof.

With such a structure, when the third control signal serving as an active level is supplied to the third transistor, the fifth transistor can be changed into ON state, it becomes unnecessary to prepare the signal wire which supplies electric power of gate-on voltage separately, and it is possible to simplify the circuit.

In the scan line driving circuit, it is preferable that the source electrodes of the fourth and fifth transistors are connected to a gate-off power supply line which supplies electric power of a gate-off voltage.

With such a structure, when the fourth transistor changes into an ON state, the fifth transistor can change into an OFF state. Further, when the fifth transistor changes into an ON state, the parasitic capacitor of the first transistor can be short-circuited.

In the scan line driving circuit, it is preferable that the source electrodes of the fourth and fifth transistors are connected to the corresponding scan line.

With such a structure, when the fourth transistor changes into an ON state, the fifth transistor changes into an OFF state. Further, when the fifth transistor changes into an ON state, the parasitic capacitor of the first transistor can be short-circuited. Moreover, it becomes unnecessary to prepare the signal wire which supplies electric power of a gate-off voltage separately, and it is possible to simplify a circuit.

In the scan line driving circuit, it is preferable that a plurality of switches is disposed to correspond to the plurality rows of scan lines, respectively. Respective ends of the switches are connected to the corresponding scan lines, respectively and respective remaining ends of the switches are commonly grounded to a non-active level. During a portion of a period or the whole period in which any of the plurality rows of scan lines is selected, a plurality of switches, which will be currently turned on, is prepared.

With such a structure, within the period in which a selection voltage is not applied to any of the scan lines, since the switches are turned on, it is possible to apply a non-selection voltage to all the scan lines and thus it is possible to prevent a high impedance state from being maintained for a long time. As a result, it is possible to prevent deterioration of picture quality, such as pixel voltage leakage caused due to the increase of leakage of non-selection potential, which is attributable to the high impedance state continued for a long time.

According to another aspect of the invention, there is provided an electro-optical device including a plurality rows of scan lines which is grouped into blocks, each block having p (p is an integer of two or more) rows, a plurality columns of data lines, pixels disposed at every intersection of the plurality rows of scan lines and the plurality columns of data lines and becoming gray-scale images corresponding to data signals supplied to the data lines when a logical level of the scan line becomes an active level, a scan line driving circuit which selects the plurality rows of scan lines in a predetermined order and changes a logical level of the selected scan line into an active level, and a data line driving circuit which supplies data signals corresponding to the gray-scale images of the pixels corresponding to the scan line having an active level via the data lines, in which the can line driving circuit includes unit circuits corresponding to the plurality columns of scan lines, respectively, and p unit circuits of the unit circuits, which correspond to p rows of scan lines belonging to one block, are supplied with a logical signal which shows an active level during every period in which each of the scan lines corresponding to the p rows is selected, in which each of the unit circuits includes a first transistor having a source electrode to which the logical signal is supplied and a drain electrode connected to the corresponding scan line, a second transistor having a gate electrode to which a first control signal is supplied, a source electrode to which a second control signal is supplied, and a drain electrode connected to a gate electrode of the first transistor, and a short-circuiting circuit which causes a short-circuited state to a parasitic capacitor of the first transistor.

With such a structure, it is possible to drive scan lines of an electro-optical device by a demultiplexer system with a simple structure.

According to a further aspect of the invention there is provided an electronic apparatus including the electro-optical device.

With such a structure, it is possible to provide an electronic apparatus by which improvement of display quality can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

Figure 1:
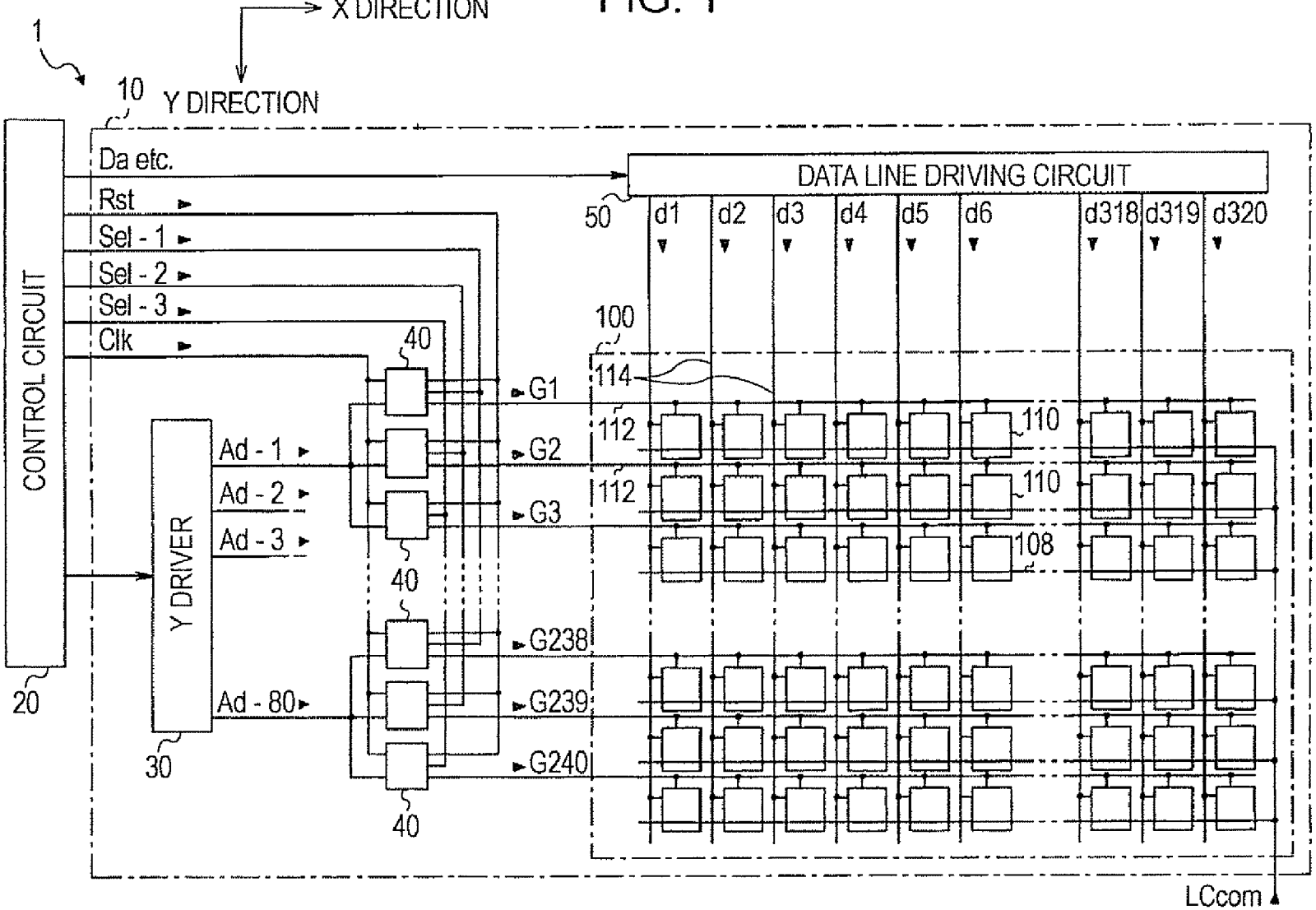
FIG. 1 is a block diagram illustrating the structure of an electro-optical device according to a first embodiment of the invention.

FIG. 1 is a view illustrating the overall structure of an electro-optical device including a scan line driving circuit according to one embodiment of the invention.

As shown in FIG. 1, the electro-optical device 1 includes a display panel 10*r* a control circuit 20, a Y driver 30, and a data line driving circuit 50. Among these elements of the electro-optical device, the display panel 10 is structured such that an element substrate and an opposing substrate are bonded to each other with a predetermined gap therebetween so that electrode-formed surfaces of the substrates (not shown) face each other, and the gap is sealed while being supplied with twisted nematic type (TN type) liquid crystal.

On the element substrate of the display panel 10, switching elements serving as pixels which will be described below and elements of unit circuits 40 are provided by a common manufacturing process. Further, the Y driver 30 and the data line driving circuit 50, each being a semiconductor chip, are mounted by a COG technique. The Y driver 30, the unit circuit 40, and the data line driving circuit 50 are supplied with a variety of control signals from a control circuit 20 via a flexible printed circuit (PCB) board.

The display panel 10 has a display domain 100. With this embodiment, the display domain 100 is provided with 240 rows of scan lines 112 which extend in an X direction and 320 columns of data lines 114 which extend in Y direction. Further, the scan lines 112 and the data lines 114 are disposed so as to be electrically insulated from each other. With this embodiment, there are 240 scan lines. The 240 rows of scan lines 112 are grouped into blocks, each block including 3 rows. Accordingly, there are 80 scan line blocks.

The pixels 110 are arranged corresponding to intersections of the 240 rows of scan lines 112 and 320 columns of data line 114, respectively. Therefore, with this embodiment, the pixels 110 will arrange in a matrix of 240 rows and 320 columns in the display domain 100.

For convenience's sake, in order to generalize and explain rows (block) in the display domain, when an integer m (m is 80 or less) is used, in FIG. 1, the scan lines 112 disposed at the (3m−2)-th row, (3m−1)-th row, and (3m)-th row from the top of the figure belong to the m-th scan line block.

Figure 2:
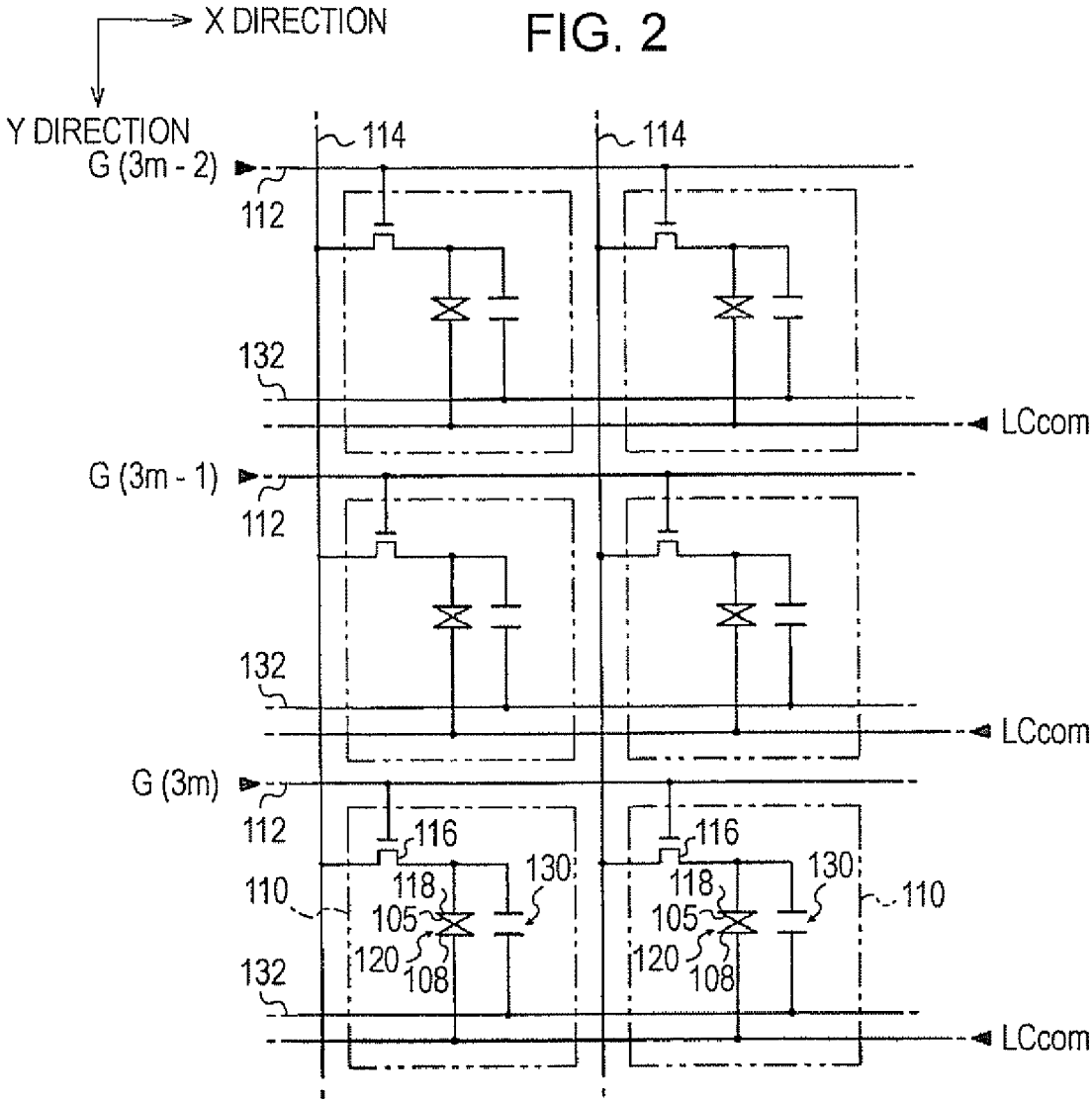
FIG. 2 is a view illustrating the structure of a pixel.

Next, the structure of the pixel 110 will be described. FIG. 2 is a view illustrating the structure of the pixel 110, and shows a total of 6 pixels (3 rows×2 columns) disposed corresponding to intersections between the scan lines 112, the (3m−2)-th row, the (3m−1)-th row, and the (3m)-th row, belonging to the m-th scan line block and a certain column and a neighboring column adjacent to the certain column. As shown in FIG. 2, each of the pixels 110 includes an n-channel thin film transistor 116 (hereinafter, referred to as TFT) which serves as a switching element of a pixel, a pixel capacitor (liquid crystal capacitor) 120, and a storage capacitor 130. All of the pixels 110 have the same structure. In one pixel, a gate electrode of a TFT 116 in the corresponding pixel 110 is connected to the corresponding scan line 112, a source electrode of the TFT 116 is connected to the corresponding data line 114, a drain electrode of the TFT 116 is connected to a pixel electrode 11, which is one end of the pixel capacitor 120, and one end of the storage capacitor 130.

The other end of the pixel capacitor 120 is a common electrode 108. As shown in FIG. 1, the common electrode 108 is in common over all the pixels 110. With this embodiment, this common electrode 108 is kept at a predetermined fixed voltage LCcom for a predetermined period. On the other hand, the other end of the storage capacitor 130 is a capacitor line 132. The capacitor line 132 is maintained at the same voltage LCcom as the common electrode 108 although illustration thereof is omitted in FIG. 1. In addition, the capacitor line 132 may be structured to be maintained in a voltage other than the voltage LCcom.

The display domain 100 has the structure in which a pair of substrate, including an element substrate on which the pixel electrode 118 is formed and an opposing substrate on which the common electrode 108 is formed, is bonded to each other with a predetermined gap therebetween in a manner such that electrode-formed surfaces thereof face each other. Further, the gap is filled with liquid crystal 105 and sealed. For this reason, the pixel capacitor 120 is formed by the pixel electrode 118, the common electrode 108, and the liquid crystal 105 which is a kind of dielectric and interposed between the pixel electrode 118 and the common electrode 108. Thus, the pixel capacitor 120 can main a difference voltage of the picture electrode 118 and the common electrode 108. In this structure, the penetration light amount of the pixel capacitor 120 change according to the effective value of the maintenance voltage. In addition, with this embodiment, if the voltage effective value maintained in the pixel capacitor 120 approaches zero (0), the transmissivity of light becomes the maximum, resulting in a white display. Further, as the voltage effective value becomes larger and, the penetrated light amount decreases. Thus, it becomes a normally white mode in which the transmissivity of light becomes the minimum value, resulting in a black display.

In FIG. 1 the Y driver 30 generates address signals (logical signals) Ad-1, Ad-2, Ad-3, . . . , Ad-80 used for selecting three scan lines belonging to the scan line blocks 1, 2, 3, . . . 80 in turn according to the control performed by the control circuit 20. Here, for convenience's sake of explanation, is referenced as Ad-m.

In this embodiment, the scan line driving circuit is an aggregate of unit circuits 40 prepared so as to correspond to first ($1^{st}$) to two hundred fortieth ($240^{th}$) scan lines 112 one to one. An output terminal of each of the unit circuit 40 is connected to the corresponding scan line 112 associated with itself. Accordingly, the first ($1^{st}$), second ($2^{nd}$), third ($3^{rd}$), two hundred fortieth ($240^{th}$) unit circuits 40 supply scan line signals G1, G2, G3, . . . , and G240 to the first ($1^{st}$), second ($2^{nd}$), third ($3^{rd}$), . . . , and two hundred fortieth ($240^{th}$) rows of scan lines 112, respectively.

Here, the address signal Ad-m outputted corresponding to one scan line block is supplied to input terminals of three unit circuits 40 corresponding to the scan lines 112 of the (3m−2)-th row, (3m−1)-th row, and (3m)-th row belonging to the m-th scan line block. For example, the address signal Ad-80 is supplied in common to the input terminals of three unit circuits 40 corresponding to the scan lines 112 of the 238th row, the 239th row, and the 240th row belonging to the 80th scan line block.

Moreover, a clock signal (first control signal) Clk is supplied in common to all the unit circuits 40. On the other hand, select signals (second control signals) different from each other are supplied to the unit circuits of three rows belonging to the m-th scan line block. In greater detail, a select signal Sel-1 is supplied to the unit circuit 40 corresponding to the (3m−2)-th row, a select signal Sel-2 is supplied to the unit circuit 40 corresponding to the (3m−1)-th row, and a select signal Sel-3 is supplied to the unit circuit 40 corresponding to the (3m)-th row. In other words, in one scan line block, three rows of unit circuits from the top of the figure are supplied with the select signals Sel-1, Sel-2, and Sel-3, respectively.

Here, as for the select signals Sel-1, Sel-2, and Sel-3, if n select signals are used, the n-th select signal is referenced by Sel-n. Here, n may be 1, 2, or 3.

Furthermore, a reset signal (third control signal) Rst is supplied to all the unit circuits 40 in common. Thus, the clock signal Clk, the select signals Sel-1, Sel-2, Sel-3, and the reset signal Rst are outputted from the control circuit 20. Here, the address signal Ad-m, the select signal Sel-n and the clock signal Clk, and the reset signal Rst are explained with reference to FIG. 4.

Figure 4:
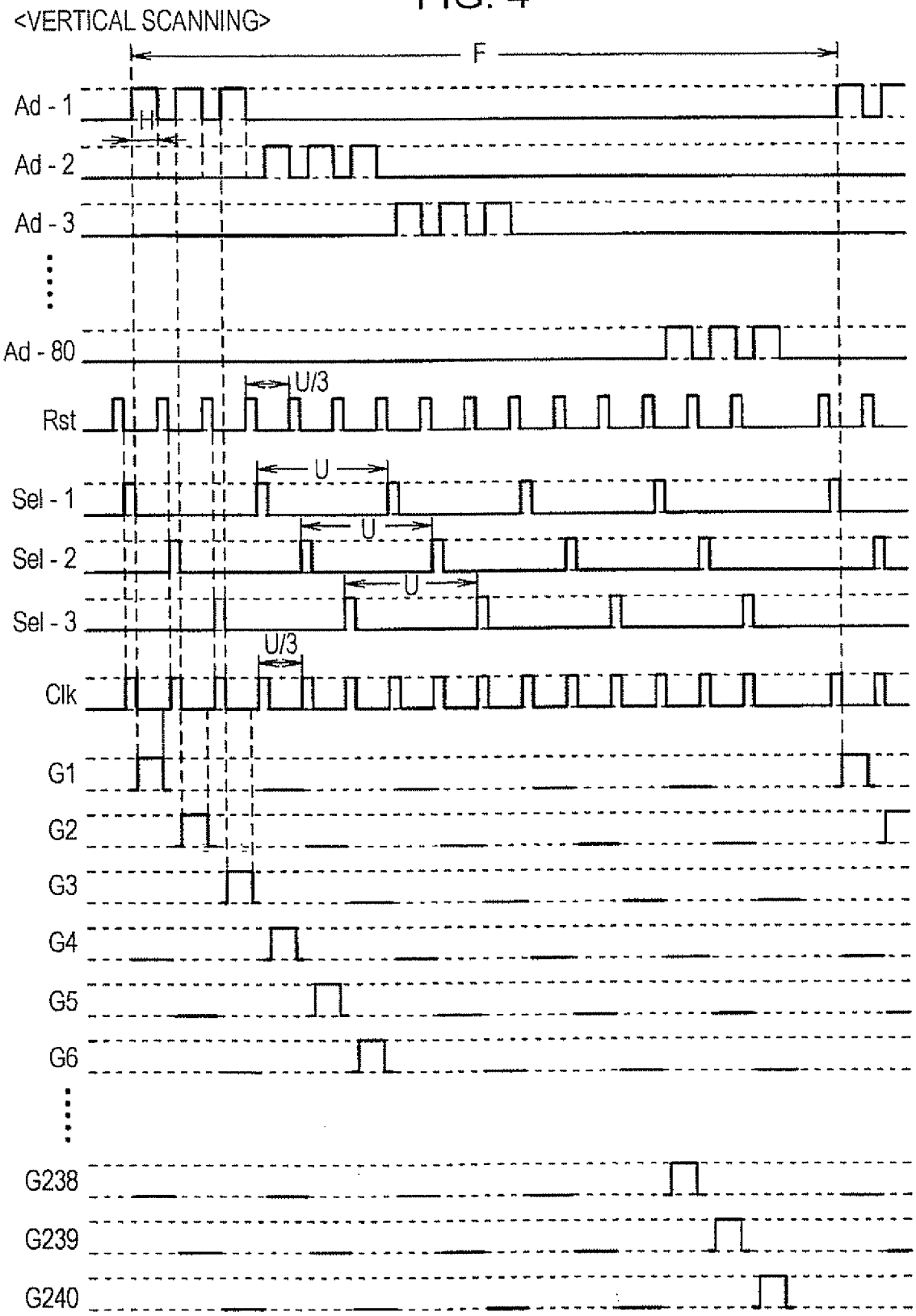
FIG. 4 is a timing charge illustrating operation of a can line driving circuit according to a first embodiment of the invention.

As shown in FIG. 4, each of the address signals Ad-1, Ad-2, Ad-3, . . . , and Ad-80 is a train of pulses comprising three shots of pulses having a pulse width of H and the address signals are outputted in turn so that the pulse trains, each from a start point to an end point, do not overlap each other. The select signal Sel-1 is a pulse outputted in a period in which the address signals Ad-1, Ad-2, Ad-3, . . . , and Ad-80 have an L level just before the first shot is outputted for each of the pulse trains of the address signals Ad-1, Ad-2, Ad-3, . . . , and Ad-80. The select signals Sel-2 is a pulse outputted between the first shot and the second shot of each pulse train for each of the address signals Ad-1, Ad-2, Ad-3, . . . , and Ad-80. The select signal Sel-3 is a pulse outputted between the second shot and the third shot of each pulse train for each of the address signals Ad-1, Ad-2, Ad-3, . . . , and Ad-8.

With this embodiment, the select signals and the address signals are generated so that a falling of the select signal Sel-1 and a rising of the first shot of each of address signals Ad-1, Ad-2, Ad-3, . . . , and Ad-80 are coincidence. In similar way, a falling of the select signal Sel-2 and a rising of the second shot of each of the address signals Ad-1, Ad-2, Ad-3, . . . , and Ad-80 are coincidence. Further, a falling of the select signal Sel-3 and a rising of the second shot of each of the address signals Ad-1, Ad-2, Ad-3, . . . , and Ad-80 are coincidence.

The clock signal Clk is outputted in the timing at which any one pulse of the select signals Sel-1, Sel-2, and Sel-3 is outputted. That is, the clock signal Clk is a signal equivalent to the logical sum of the select signals Sel-1, Sel-2, and Sel-3. The reset signal Rst is a pulse outputted during a period in which all of the address signals Ad-1, Ad-2, Ad-3, . . . , and Ad-80 have an L level, just before the clock signal Clk is outputted. With this embodiment, the reset signal is generated in a manner such that a falling of the reset signal Rst and a rising of the clock signal Clk are coincidence.

The data line driving circuit 50 is a circuit for supplying voltages of data signals d1, d2, d3, . . . , and d320 to the first ($1^{st}$), second ($2^{nd}$), third ($3^{rd}$), . . . , and three hundred twentieth ($320^{th}$) data lines 114 according to gray-scale images of the pixels 110 associated with the scan lines 112 having an active level H. Here, the data line driving circuit 50 has memory domains (not shown) arranged in a matrix of 240 rows (vertical direction)×320 columns (horizontal direction). Each of the memory domains stores display data Da which specifies a gray-scale value (brightness) of the corresponding pixel 110. When display content is changed, the changed display data Da and address are supplied by the control circuit 20, so that the display data Da stored in each of the memory domains is rewritten.

The data line driving circuit 50 reads out the display data Da of the pixels 110 located at the scan line 112 having an H level from the memory domains, changes the read data into data signals of voltages corresponding to the gray-scale values, and supplies the data signals to the data lines 114. The data line driving circuit 50 performs such operation with respect to each of first to $320^{th}$ pixels associated with the corresponding scan line 112.

In addition, about what number of the scanning line 112 will become an H level and at which timing the scanning line 112 becomes an H level are determined by the control (address signals Ad-1, Ad-2, Ad-3, . . . , and Ad-80) to the Y driver 30 by the control circuit 20, and the control (select signals Sel-1, Sel-2, and Sel-3) to the unit circuits 40.

For this reason, the data line driving circuit 50 can come to know that which line of the display data Da should be read and at which timing the data signals d1, d2, d3, . . . , and d320 should be outputted by receiving the notice of the contents of the control from the control circuit 20.

Here, as for the voltages corresponding to the gray-scale images, there are two kinds including a positive polarity which is higher than the voltage LCcom applied to the common electrode 108 and a negative polarity lower than the voltage LCcom. The data line driving circuit 50 alternates the positive polarity and the negative polarity every one frame of period with respect to the same pixel. As for the write polarity, the voltage LCcom is used as the reference. However, as for the voltage, ground potential Gnd may is the reference voltage as long as there is not explanation given especially. The ground potential Gnd is an L level in the logical level, and a voltage Vdd is an H level in the logical level.

Next, the unit circuit 40 which is a characterizing portion of this invention will be described below.

Although the unit circuits 40 corresponding to the first to $240^{th}$ scan lines 112 have the same structure, but the address signals and the select signals supplied to the units 40 are different from each other, depending on to what number of the scan line block the corresponding scan line 112 belongs and what number is the corresponding scan line 112 in the scan line block. As mentioned above, m shows the number of scan line blocks, and n shows the number of row of three scan lines in each scan line block. Accordingly, among three scan lines belonging to the m-th scan line block, the n-th scan line 112 becomes {3(m−1)+n}-th row of the first to $240^{th}$ rows in the display panel 10, and the unit circuits corresponding to this scan line are supplied with the address signal Ad-m and the select signal Sel-n.

Figure 3:
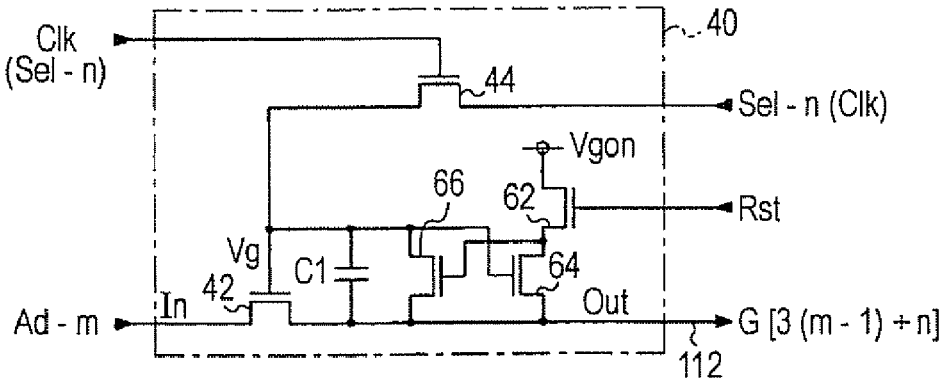
FIG. 3 is a view illustrating the structure of a unit circuit.

FIG. 3 shows the structure of the unit circuit 40 corresponding to the {3(m−1)+n}-th scan line 112.

Among these, a source electrode of a TFT 42 (first transistor) is connected to an input terminal In to which the address signal Ad-m is supplied, and a drain electrode of the TFT 42 is connected to an output terminal Out which is an end of the {3(m−1)+n}-th scan line 112.

The clock signal Clk is supplied to a gate electrode of a TFT 44 (second transistor), the select signal Sel-n is supplied to a source electrode of the TFT 44, and a drain electrode of the T'FT 44 is connected to the gate electrode of the TFT 42.

Moreover, C1 is a parasitic capacitor between the gate and drain electrodes of the TFT 42. Furthermore, the reset signal Rst is supplied to a gate electrode of a TFT 62 (third transistor), and a source electrode of the TFT 62 is connected to a gate-on power supply line Vgon by which electric power of a gate-on voltage Vdd is supplied.

Moreover, a gate electrode of a TFT 64 (fourth transistor) is connected to the gate electrode of the TFT 42, a gate electrode of a TFT 66 (fifth transistor) is connected in common to drain electrodes of the TFT 62 and the TFT 64, and a drain electrode of the TFT 66 is connected to the gate electrode of the TFT 42.

Furthermore, source electrodes of the TFT 64 and the TFT 66 are connected to an output terminal Out which is an end of the {3(m−1)+n}-th scan line 112.

The TFTs 42, 44, 62, 64 and 66 are formed through a common process by which TFTs 116 in the pixels 110 are formed.

In FIG. 3, the TFTs 62, and 64 and 66 constitute a short-circuiting circuit.

Next, operation of the unit circuit 40 will be described.

Figure 5:
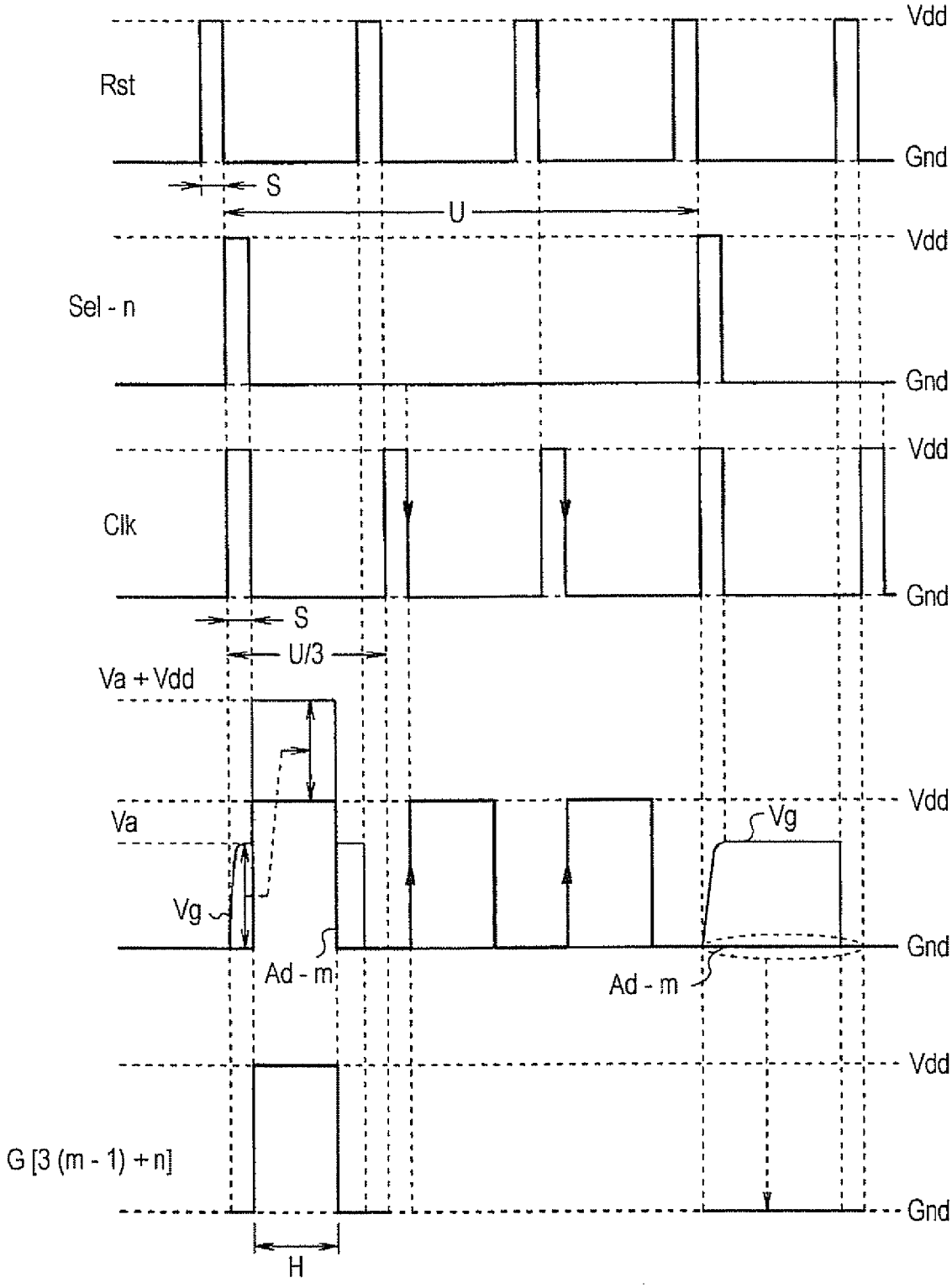
FIG. 5 is a timing chart illustrating operation of a unit circuit according to the first embodiment.

In the unit circuit 40 corresponding to the {3(m−1)+n}-th scan line 112, as shown in FIG. 5 (FIG. 4), while the reset signal Rst is set to H level over a period S. After that, the reset signal Rst falls to L level, and the select signal Sel-n and the clock signal Clk are set to H level over the period S. Then, if the select signal and the clock signal falls to L level while the address signal Ad-m rises to H level, and then time H passes from the rise of the address signal, the address signal Adam falls to L level. In the state in which the select signal Sel-n is L level, if an operation in which the reset signal Rst becomes H level and then the clock signal Clk becomes H level is performed two times, after the next reset signal Rst becomes H level, the select signal Sel-n and the clock signal Clk simultaneously become H level.

In outputs of such select signal Sel-n, the clock signal Clk, the reset signal Rst, and the address signal Ad-m, if the reset signal Rst becomes H level, since the gate electrode of the TFT 62 becomes the voltage Vdd equivalent to H level in the unit circuit 40 corresponding to the {3(m−1)+n}-th scan line 112, the corresponding TFT 62 will be in an ON state. As a result, the TFT 66 will be in an ON state and the capacitor C1 is short-circuited.

After that, if the reset signal Rst becomes L level and the select signal Sel-n and the clock signal Clk become H level, the gate electrode of the TFT 44 becomes the voltage Vdd corresponding to H level. Accordingly, the corresponding TFT 44 turns on.

On the other hand, since the address signal Ad-m is L level, the gate electrode Vg of the TFT will reach a voltage Va which is a voltage obtained by subtracting the value corresponding to the voltage drop attributable to ON resistance of the TFT 44 from the voltage Vdd which is H level of select signal Sel-n while charging the capacitor C1.

Since the TFT 42 turns on with this voltage Va, the output terminal Out and the input terminal In will be electrically conducted. Moreover, at the same time, the TFT 64 turns on, the TFT 66 will be in a non-electrical connection (OFF) state, and the short-circuited state of capacitor C1 will be canceled. At this time, L level of the address signal Ad-m is set to the scanning signal G{3(m−1)+n}].

Next, if the address signal Ad-m rises to H level while the select signal Sel-n and the clock signal Clk fall to L level, the TFT 44 turns off. Therefore, although the gate electrode of the TFT 42 will be in the high impedance state in which the gate electrode of the TFT 42 is electrically connected to no portion, since the address signal Ad-m is raised to the voltage Vdd equivalent to H level, the gate electrode Vg of the TFT 42 also goes up to a voltage (Va+Vdd) which is a value obtained by adding the voltage Vdd to the last voltage Va.

At this time, since the TFT 42 will be in an ON state continuously, H level of the address signal Ad-m appears as the scanning signal G [3(m−1)+n] as it is (a selection voltage is outputted). Then, the address signal Ad-m falls to L level. For this reason, the gate electrode Vg of the TFT 42 falls by the voltage Vdd, and returns to the voltage Va. Since the TFT 42 is in an ON state continuously at this time, L level of the address signal Ad-map pears as the scanning signal G[3(m−1)+n] as it is (a non-choosing voltage is outputted).

In this state, if the reset signal Rst becomes H level, the TFT 62 turns on, the TFT 66 also turns on, and the capacitor C1 is short-circuited again, Then, if the clock signal Clk is set to H level in the state in which the select signal Sel-n and the address signal Ad-m are set to L level, the TFT 44 will turn on. For this reason, since the gate electrode Vg becomes L level of the select signal Sel-n, the TFT 42 turns off.

At this time, the TFT 64 is in on OFF state and the TFT 66 maintains an ON state. That is, the short-circuited state of the capacitor C1 is maintained. Therefore, even if the address signal Ad-m becomes H level again, the gate electrode Vg maintains an OFF state with L level and thus a high impedance state is maintained. In addition, in this circuit structure, when the TFT 66 is in an ON state, the TFT 44 has the capability to pull up the gate voltage of the TFT 64 to be higher than the threshold voltage.

By the way, the address signal Ad-m maintains L level until a period F of one frame passes after three scan lines 112 belonging to the m-th scan line block become H level in turn. However, the select signal Sel-n becomes H level in every period U in order to select three scan lines 112 belonging to other scan line block in turn. Since the clock signal Clk has the characteristic of the logical sum of the select signals Sel-1, Sel-2, and Sel-3, it becomes H level together with one of the select signals in every period U/3.

Since the gate electrode of the TFT 42 becomes H level if the select signal Sel-n and the clock signal Clk are set to H level when the address signal Ad-m is L level, the output terminal Out fixes the address signal to L level. For this reason, since the output terminal Out is periodically refreshed with L level with the cycle of period U after it is in a high impedance state, the voltage change caused by noise and various kinds of parasitic capacitors will be suppressed.

As mentioned above, when the address signal Ad-m is L level, if the gate electrode Vg is set to H level and the corresponding TFT 42 turns on, the voltage Va will be charged by the capacitor C1. However, since the reset signal Rst is set to H level after that, the capacitor C1 is short-circuited and the charged voltage is reset to zero.

Here, although the {3(m−1)+1}-th unit circuit 40 is generally explained above, since m is in the range from 1 to 80 and n is in the range from 1 to 3, if the select signals Sel-1, Sel-2, and Sel-3 are outputted to the address signals Ad-1, Ad-2, Ad-3, and Ad-80 shown in FIG. 4, the scan signals G1, G2, G3, . . . , and G240 are configured to include a period of L level with respect to a pulse corresponding to the number of row of the scan line block of three pulse trains in the address signals.

Moreover, the output terminal Out temporarily becomes the high impedance state during a period in which the scan signal is L level. Accordingly, the voltage is easy to fall into indefinite state. With this embodiment, since the output terminal is periodically refreshed to L level which is the ground potential Gnd in every period U, the output terminal is stabilized at L level.

In FIG. 4, during a period in which each of the scan signals is L level, a thin line shows the period in which each of the scan signals is unstable due to the parasitic capacitance of the scan line because the TFT is in a high impedance state but maintains L level, and a thick line shows the period in which the scan signal is settled to L level by the refresh.

In this way in the unit circuit 40 corresponding to {3(m−1)+n}-th row, before making the corresponding scan line 112 into H level, the TFT 42 is turned on. Accordingly, the address signal Ad-m of L level is set to the scanning signal G[3(m−1)+n] as it is and the capacitor C1 is charged to the voltage Va. After that, when changing the address signal Ad-m to H level, a gate voltage of the TFT 42 is raised from the voltage Va by the variation, and thus the TFT 42 is continuously in an ON state. As a result, the address signal Ad-m of H level is outputted as the scanning signal G[3 (m−1)+n].

For this reason, the gate voltage of the TFT 42 constituting a demultiplexer is self-generated by using H level and L level which are logical levels. Thus, it becomes unnecessary to generate separately a voltage higher than H level by the threshold voltage of the TFT 42 as a gate-on voltage which should be applied to the gate electrode of the TFT 42. For this reason, since what is necessary is to generate only the voltage Vdd equivalent to H level besides the potential Gnd equivalent to L level upon driving the scan lines, it becomes unnecessary to form the power supply circuit by high breakdown voltage elements, resulting in simplification of the structure.

By the way, in the case in which the TFTs 62, 64, and 66 are not formed in the unit circuit 40, when the address signal Ad-m rises to H level from L level in the state where the select signal Sel-n and the clock signal Clk are L levels after only the clock signal Clk is set to H level, the gate electrode voltage of the TFT 42 changes in a voltage variation direction in which the voltage of the address signal Ad-m rises due to the influence of the capacitor C1 and other capacitors. By this, there is the possibility that the off resistance of the TFT 42 is decreased to a negligible level. If the TFT 42 becomes a half-ON state, the scan line which is the output terminal Out rises from L level, and the off-leak of the TFT 116 in the pixel will be increased.

In order to prevent the half-ON state, with this embodiment, TFTs 62, 64, and 66 are provided and the reset signal Rst is set. That is, since the capacitor C1 is short-circuited at a rising time of the reset signal Rst, the address signal Ad-m can rise from L level to H level in the state in which the select signal Sel-n is L level. Thus, the TFT 42 can maintain an OFF state.

In addition, operation of the electro-optical device will be described briefly. The scanning signal G1 is set to H level in the beginning of a certain frame. When the scanning signal G1 becomes H level, the data line driving circuit 50 reads the display data Da from the pixels disposed on first, second, third, . . . , and three hundred twentieth columns and on the first row, and changes the voltage LCcom by voltages in the display data Da to a high potential voltage and a low potential voltage. The changed voltages are supplied to the first, second, third, . . . , and three hundred twentieth columns of data lines 114 as data signals d1, d2, d3, . . . , and d320, respectively.

On the other hand, if the scanning signal G1 is set to H level, since the TFTs 116 in the pixels at the first low and first column (1, 1) to first low and three hundred twentieth column (1, 320) turn on, the pixel electrodes 118 in such pixels are supplied with the data signals d1, d2, d3, . . . , and d320, respectively. For this reason, difference voltages between the data signals d1, d2, d3, . . . , and d320 and the voltage LCcom are recorded into the pixel capacitors 120 at the first low and first column (1,1) to first low and three hundred twentieth column (1, 320).

Just before the scanning signal G2 becomes H level, the scanning signal G1 becomes L level. For this reason, the TFTs 116 in the pixels at the first low and first column (1,1) to first low and three hundred twentieth column (1, 320) are turned off, but the voltages recorded in the pixel capacitors 120 are stored and maintained in the capacitors and storage capacitors 130 connected to the capacitors in parallel and the pixel capacitors 120 at the first low and first column (1,1) to first low and three hundred twentieth column (1, 320) maintains gray-scale images corresponding to the recorded voltages.

Next, the scanning signal G2 is set to H level. When the scanning signal G2 is set to H level, the data line drive circuit 50 reads the display data Da from the pixels at from the second low and first column (2, 1) to second low and three hundred twentieth column (2, 320) and changes the voltage LCcom by the voltages in the display data Da to high potential voltages or low potential voltages. Then, the changed voltages are supplied to the data lines 114 at the first, second, third, . . . , and three hundred twentieth columns as the data signals d1, d2, d3, . . . , and d320.

On the other hand, when the scanning signal G2 is set to H level, the TFTs 116 in the pixels disposed at from the second row and first column (2, 1) to the second row and three hundred twentieth column (2, 320) turn on. For this reason, the pixel electrodes 118 in these pixels are supplied with the data signals d1, d2, d3, . . . , and d320, respectively. Accordingly, the pixels at from the second row and first column (2, 1) to the second row and three hundred twentieth column (2, 320) are recorded with corresponding difference voltages between the data signals d1 to d320 and the voltage LCcom.

Such voltage recording (writing) using data signals are repeated until the scanning signals G3, G4, . . . , and G240 are set to H level. In this way, all of the pixels are recorded with the voltages responding to the gray-scale images of the pixels. In addition, in a next frame, the voltage recording is performed in the state in which the writing polarity is inverted. That is, in one pixel, if a voltage responding to a gray-scale image is a higher potential than the voltage LCcom or a lower potential than the voltage LCcom in a certain frame, the opposite potential is recorded in the next frame. With such a polarity inversion system, it is possible to prevent a direct current component from being applied to the liquid crystal 105 and deterioration or aging is prevented.

Figure 6:
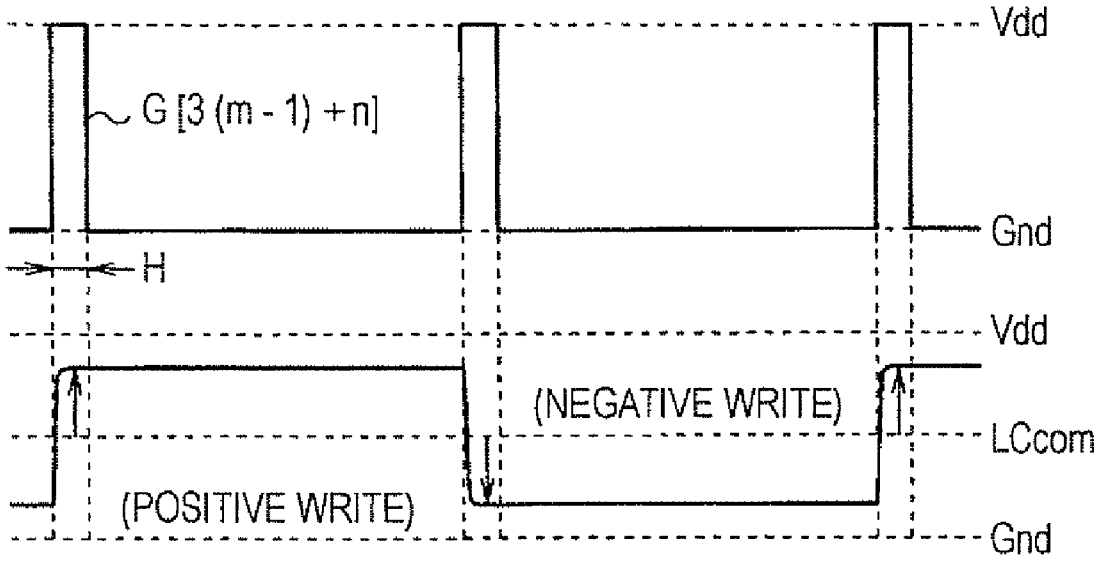
FIG. 6 is a view for explaining operation of an electro-optical device.

FIG. 6 shows the relationship between the voltage of the pixel electrode 118 at {3(m−1)+n}-th row and the scanning signal G[3(m−1)+n]-th. In FIG. 6, when the scanning signal G[3(m−1)+n] is set to H level, the data signals having potentials which are higher or lower (shown by arrows ↑, ↓ in FIG. 6) than the voltage LCcom by voltages corresponding to gray-scale images of the pixels are supplied to the corresponding data lines 114, and then written in the corresponding pixels 118. In the scanning signal G[3(m−1)+n], L level is stable.

In this way, with the first embodiment, since it is possible to self-generate the gate electrode voltage of the TFT 42 using an active level and a non-active level, it becomes unnecessary to generate voltages other than an active level and a non-active level upon driving the scan lines. As a result, it is unnecessary to additionally prepare a special high breakdown voltage driver or a power supply circuit and thus it is possible to simplify the structure.

Moreover, the short-circuiting circuit which causes the parasitic capacitor C1 of the TFT 42 to be short-circuited is prepared. With this structure, it is possible to prevent the TFT 42 from being in on a half-ON state by the variation of the gate electrode voltage Vg of the TFT 42 attributable to influence of the parasitic capacitor C1 when the address signal Ad-m changes from a non-active level to an active level after only the clock signal Clk becomes an active level. As a result, it is possible to improve display quality by preventing the off-leak current of the TFT in the pixel, which is attributable to the half-ON sate.

Moreover, the short-circuiting circuit includes the TFTs 62, 64, and 66. The TFT 62 has a gate electrode to which the reset signal Rst is supplied and a source electrode connected to an active level. The TFT 64 has a gate electrode connected to the gate electrode of the TFT 42. The TFT 66 has a gate electrode connected in common to drain electrodes of the TFT 62 and the TFT 64 and a drain electrode connected to the gate electrode of the TFT 42. Source electrodes of the TFT 64 and the TFT 66 are connected to a non-active level.

With this structure, it is possible to turn on the TFT 66 by supplying the reset signal Rst serving as an active level to the TFT 62, and cause the parasitic capacitor C1 between the gate and drain electrodes of the TFT 42 to be short-circuited.

Further, after the reset signal Rst changes from an active level to a non-active level, when activating the clock signal Clk and the select signal Sel-n to be an active level, the TFT 66 can be turned off by turning on the TFT 64. Accordingly, it is possible to cancel the short-circuited state of the parasitic capacitor C1.

Furthermore, when only the clock signal Clk is made into an active level after making the reset signal Rst into a non-active level from an active level, it is possible to maintain the short-circuited state of the parasitic capacitor C1 by maintaining the TFT 64 in an OFF state. Accordingly, even if the address signal Ad-m becomes an active level after that, it is possible to prevent the gate electrode voltage Vg of the TFT 42 from rising. In this way, it is possible to constitute the short-circuiting circuit with a comparably simple circuit structure.

Moreover, since the source electrode of the TFT 62 is connected to a gate-on power supply line, when the reset signal Rst used as an active level is supplied to the TFT 62, the TFT 66 can be turned on.

Furthermore, since the source electrodes of the TFT 64 and the TFT 66 are connected to the corresponding scan line, when the TFT 64 changes into an ON state, it is possible to turn off the TFT 66, Further, when the TFT 66 changes into an ON state, the parasitic capacitor C1 of the TFT 42 can be short-circuited. Still further, it becomes unnecessary to prepare additional signal lines for supplying electric power of the gate-off voltage separately, which leads to the simplified circuit structure.

Moreover, it is possible to realize an electro-optical device in which scan lines can be driven by a demultiplexer system with a simple structure by applying the above-mentioned scan line driving circuit to an electro-optical device.

Figure 7A:
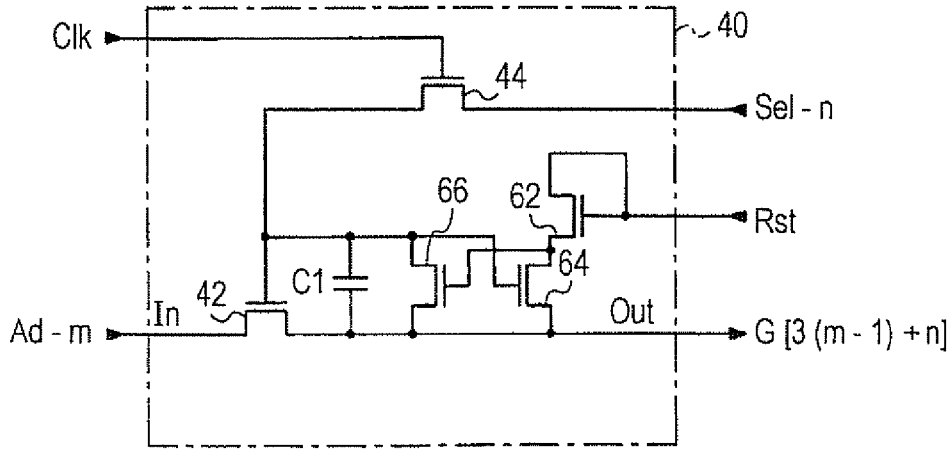
FIGS. 7A, 7B, and 7C are views illustrating the structure of further exemplary unit circuits.

In the first embodiment, an example in which the source electrode of the TFT 62 is connected to the gate-on power supply line Vgon is explained. However, when the TFT 62 is turned on, the gate electrode of the TFT 66 may be H level. As shown in FIG. 7A, the source electrode of the TFT 62 is connected to the gate electrode thereof. That is, the TFT 62 has a diode structure. In this case, it is possible to obtain the same advantageous effects as the case in which the unit circuit 40 is structured as shown in FIG. 3. Further, the invention is advantageous in that it becomes unnecessary to prepare a signal line which supplies electric power of the gate-on voltage, and it is possible to simplify the circuit structure.

Figure 7B:
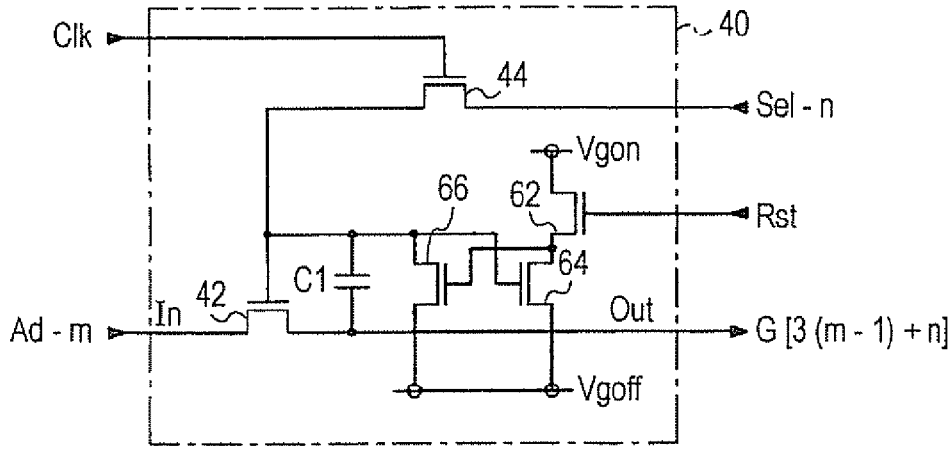
Figure 7C:
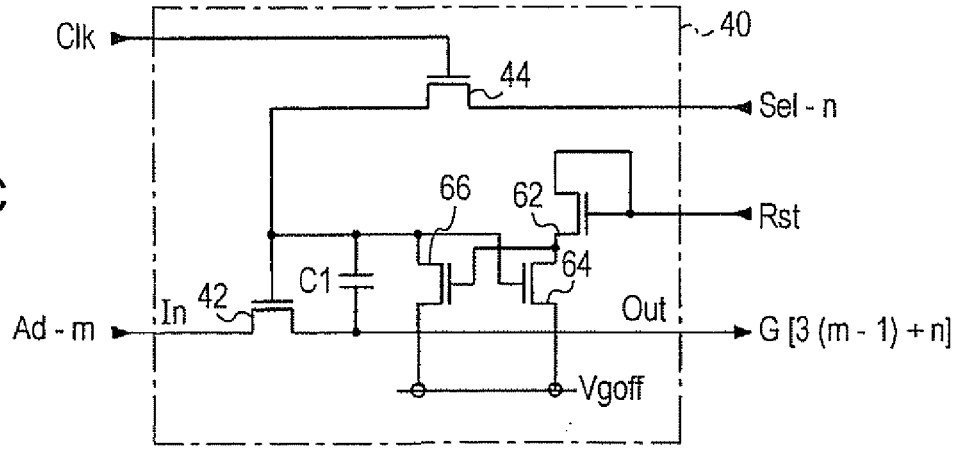

Moreover, in the first embodiment, an example in which the source electrodes of the TFT 64 and the TFT 66 are connected to the scan line 112 is explained. However, it is possible to construct the scan line driving circuit in a manner such that the capacitor C1 is short-circuited when the TFT 66 is turned on, and the gate electrode of the TFT 66 becomes L level when the TFT 64 is turned on. As shown in FIG. 7B, the source electrodes of the TFT 64 and the TFT 66 can be connected to the gate-off power supply line Vgoff which supplies electric power of the gate-off voltage Gnd. Furthermore, as shown in FIG. 7C, the source electrodes of the TFT 64 and the TFT 66 are connected to the gate-off voltage supply line Vgoff and the source electrode of the TFT 62 can be connected to the gate electrode of the TFT 62. In these cases, it is possible to obtain the same advantageous effect as the case in which the unit circuit 40 is structured as shown in FIG. 3.

Next, a scan line driving circuit according to a second embodiment of the invention will be explained.

The second embodiment interchanges the select signals Sel-1, Sel-2, and Sel-3, and the clock signal Clk as compared with the first embodiment.

That is, each of the unit circuits 40 is the same in the structure as FIG. 3, but as shown by the references in brackets in FIG. 3, in the unit circuit 40 corresponding to n-th row of three scan lines belonging to m-th scan line block, the select signal Sel-n is supplied to the gate electrode of the TFT 44 as the first control signal, and the clock signal Clk is supplied to the source electrode of the TFT 44 as the second control signal.

Figure 8:
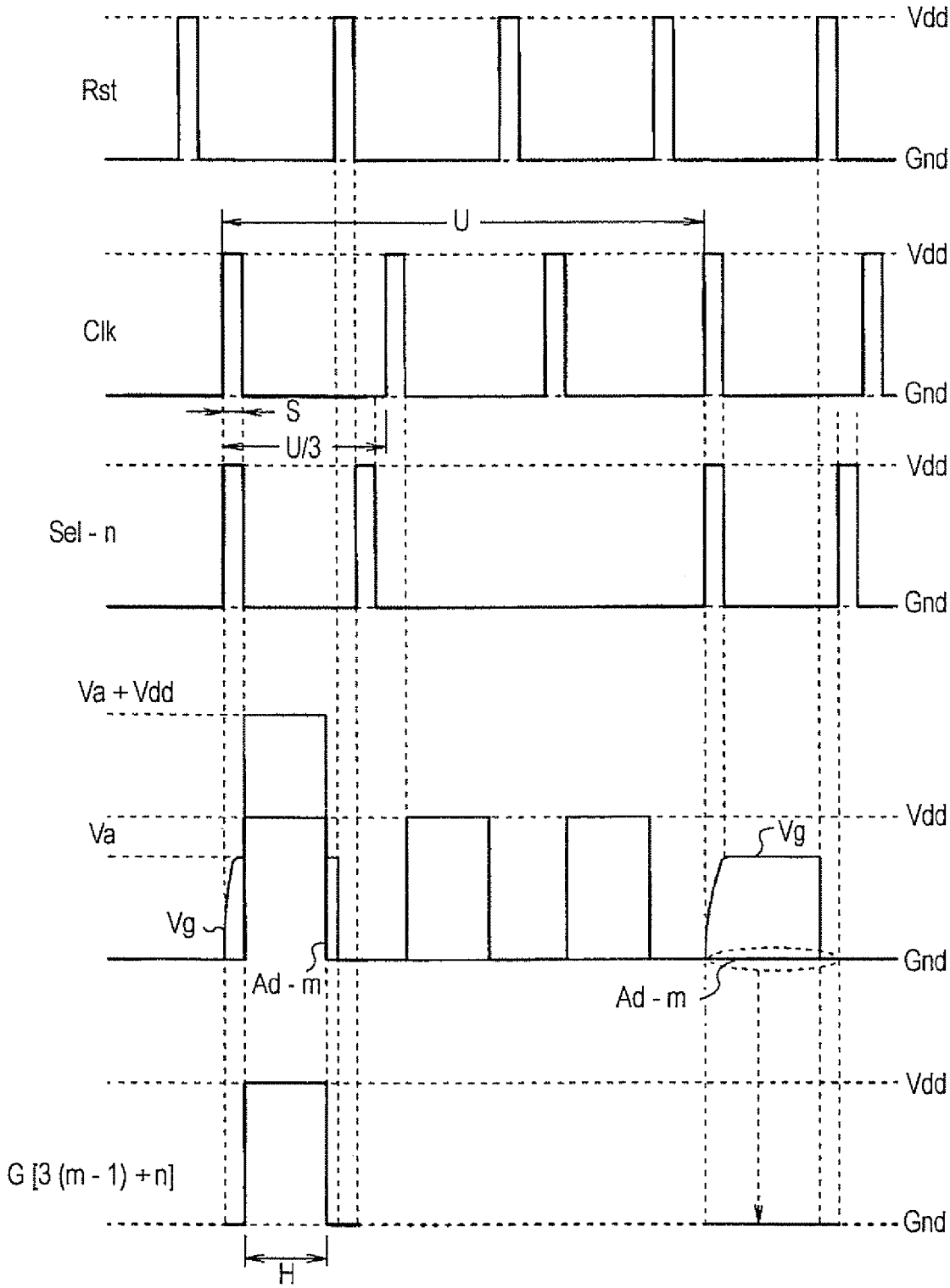
FIG. 8 is a timing chart illustrating operation of a unit circuit according to a second embodiment.

FIG. 8 shows the waveforms of the address signal Ad-m, the select signal Sel-n, the clock signal Clk, and the reset signal Rst. As shown in FIG. 8, the address signals Ad-1 to Ad-80 are the same as the first embodiment. However, the select signals Sel-1, Sel-2, and Sel-3 are different from the first embodiment. That is, the select signal Sel-1 includes a first pulse outputted during a period in which all of the address signals Ad-1, Ad-2, Ad-3, . . . , and Ad-80 are L level just before the first shot is outputted for each of the pulse trains of the address signals Ad-1, Ad-2, Ad-3, . . . , and A-80. This is the same as the first embodiment. In the second embodiment, the select signal Sel-1 includes a second pulse which is outputted during a period in which the address signals and the clock signal Clk are L level after the first shot of the address signals is outputted and before the subsequent second shot is outputted. Further, the select signals Sel-1 and Sel-2 are the same as in the first embodiment.

For this reason, with the second embodiment, although the clock signal Clk is the same as the first embodiment, it is not the logical sum of the select signals Sel-1, Sel-2, and Sel-3.

Moreover, the reset signal Rst is outputted, just before the second pulse of the select signal Sel-n is outputted, during a period in which all of the address signals Ad-1, Ad-2, Ad-3, . . . and Ad-80 is L level. Here, a rising of the reset signal Rst and a falling of the second pulse of the select signal Sel-n cannot be coincidence.

Also in this second embodiment, in the unit circuit 40 corresponding to {3(m−1)+n}-th row, as shown in FIG. 8, before making the corresponding scan line 112 into H level, since the select signal Sel-n and the clock signal Clk are set to H level, the address signal Ad-m having L level comes to serve as the scan line signal G[3(m−1)+n] as it is, and the voltage Va is charged in the capacitor C1. After that, when the address signal Ad-m is changed into H level, the TFT 42 turns on and maintains the ON state by increasing the gate voltage Va of the TFT 42 by the voltage Va. Therefore, the address signal Ad of H level is outputted as the scan signal G[3(m−1)+n]. Then, if the address signal Ad-m is set to L level, L level of the address signal Ad-m will appear as the scanning signal G[3(m−1)+n] as it is. When the reset signal Rst becomes H level, the capacitor C1 is short-circuited. After that, the TFT 42 is turned off by the second pulse of the select signal Sel-n.

Therefore, also in the second embodiment, like the first embodiment, since the gate voltage of the TFT 42 is self-generated by using H level and L level which are logical levels, it becomes unnecessary to adopt a high breakdown structure for component elements of the power supply circuit, and thus the structure can be simplified. Further, since the reset signal Rst with H level causes the capacitor C1 to be short-circuited before the address signal Ad-m becomes H level, even if the address signal Adam becomes H level again after the scan line 112 is set to H level, the OFF state of the TFT 42 is maintained, and L level of the scan line 112 can be maintained.

Figure 9:
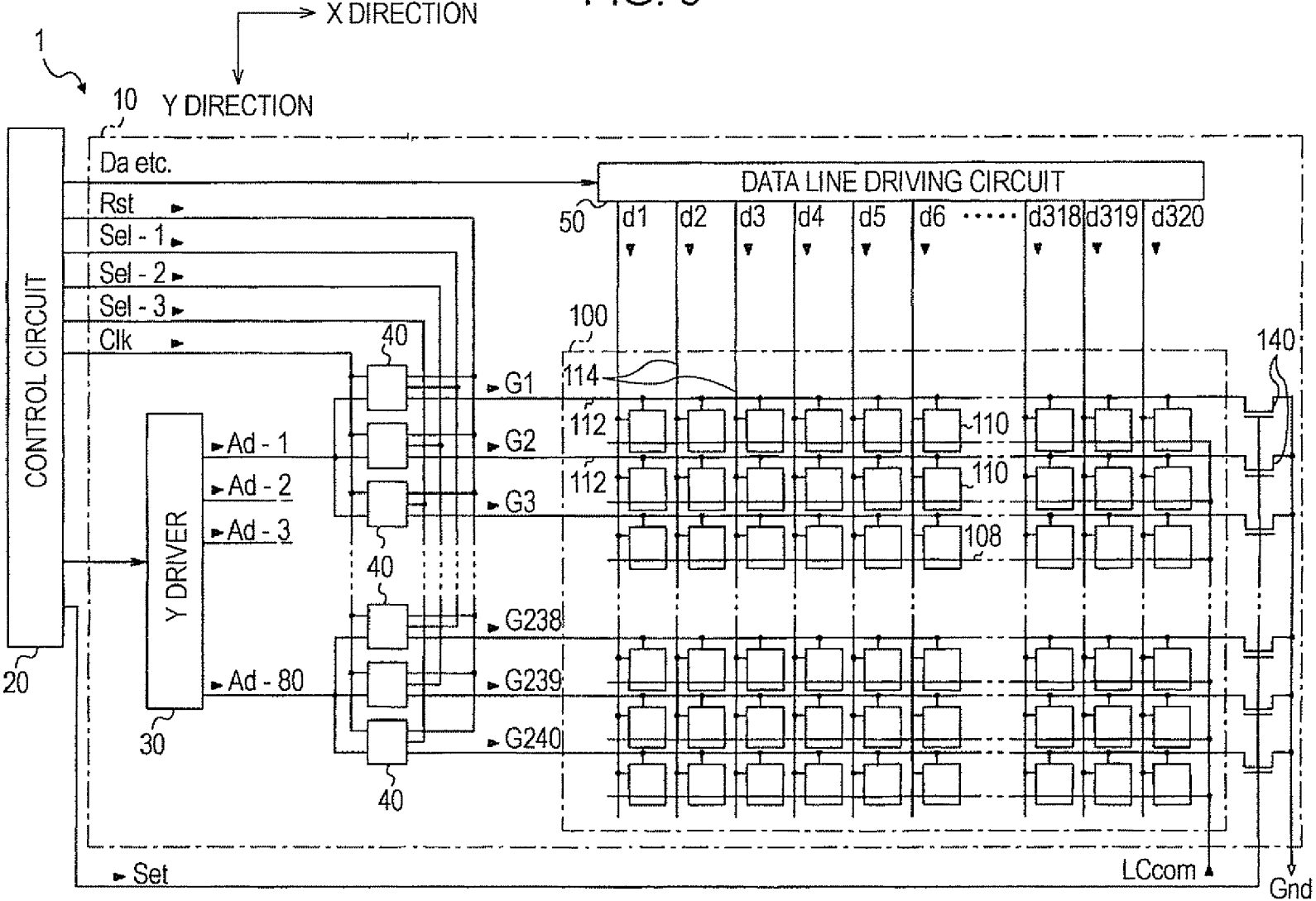
FIG. 9 is a block diagram illustrating an application of an electro-optical device.

In addition, in each if the above-mentioned embodiments, as shown in FIG. 9, it is preferable that each of the scan lines 112 is provided with the TFT 140 (switch). Here, source electrodes of the TFTs 140 are grounded in common to a potential Gnd which is L level, drain electrodes of the TFTs 140 are connected to the scan lines 112, respectively, and gate electrodes of the TFTs 140 are applied with the signal Set. Accordingly, when the signal Set becomes H level, all of the scan lines 112 are settled to L level.

Here as a signal Set, a period in which any of the address signals Ad-1, Ad-2, Ad-3, . . . , and Ad-80 becomes H level, i.e. a period in which all of the address signals becomes L level, it is preferable that there is a signal having H level. For example, the clock signal Clk mentioned above can be used as it is.

With such a structure, a settlement interval for settling the level of each of the scan lines 112 to L level becomes shorter, a voltage unstable state attributable to the high impedance sate which is continued for a long period is suppressed, and uniformity of L level in scan lines 112 can be attained.

In the high impedance state, if voltages of the scan lines 112 come to be different from each other due to the voltage variation, the influences of the off-leak of the TFT 116 in the pixel are different for every low. This is led to the unevenness of the display in a row direction. However, with such a structure, since a determination period of L level is relatively short as compared with the case shown in FIG. 4 and this is common for the entire scan lines 112, the unevenness of a display does not appear easily.

In addition, in each of the above-mentioned embodiments, although the number p of rows of the scan lines which constitute one scan line block is explained as "3," the number p may be "2" or be an integer of "4" or more. In particular, by determining the integer as the number which is near the square root of the number of scan lines, the total of the address lines and the selection lines can be minimized.

Moreover, in each of the above-mentioned embodiments, although the case where this invention is applied to the electro-optical device using liquid crystal is explained, the invention also can be applied to electro-optical devices using electro-optical materials other than liquid crystal. For example, the invention can be applied to a display panel using OLED elements, such as organic electroluminescence and a light emitting polymer, as an electro-optical material, an electrophoresis display panel using microcapsules containing colored liquid and white particles distributed in the colored liquid as an electro-optical material, a twist ball display panel using twist balls coated with different colors for every domain having different polarities as an electro-optical material, a toner display panel using black toner as an electro-optical material, a plasma display panel using high pressure gas, such as helium and neon as an electro-optical material, or various kinds of electro-optical devices.

Next, an electronic apparatus to which the above-mentioned electro-optical device 1 is applied will be described.

Figure 10:
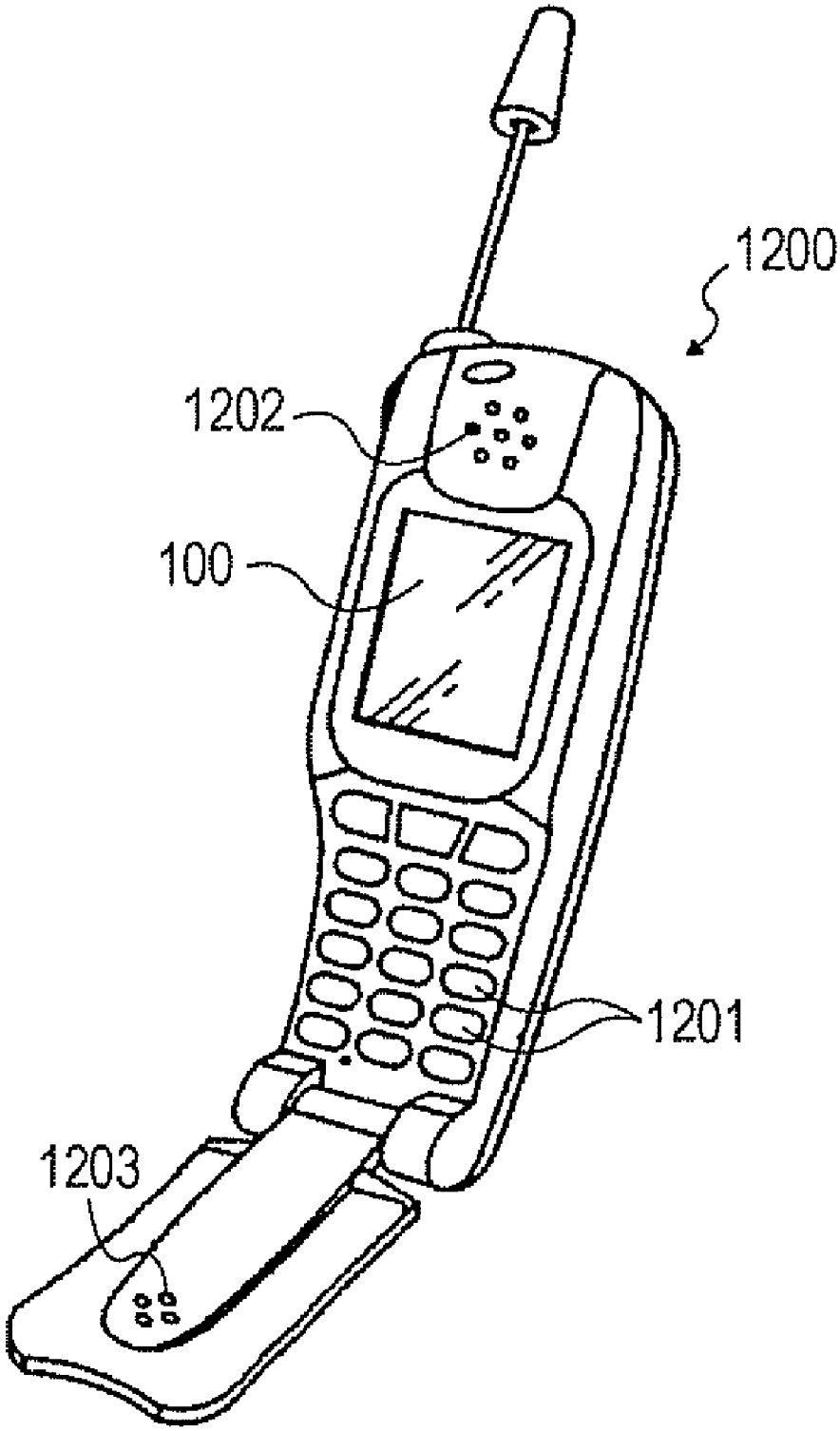
FIG. 10 is a view illustrating a cellular phone to which the electro-optical device of the invention is applied.

FIG. 10 is a perspective view illustrating the structure of a cellular phone 1200 including the electro-optical device 1.

As shown in FIG. 10, the cellular phone 1200 includes a plurality of manipulation buttons 1201, a receiver 1202, a speaker 1203, and a display domain 100. In the electro-optical device 1, since elements other than the display domain 100 are built in the phone, we cannot see the elements from the outside the cellular phone.

Besides the cellular phone shown in FIG. 10, as an electronic apparatus to which the electro-optical device 1, there are a digital still camera, a note book computer, a liquid crystal TV set, a view-finder type (or a monitor type) video recorder, a car navigation device, a pager, an electronic organizer, a calculator, a word processor, a workstation, a television phone, a POS terminal, and apparatuses employing a touch panel. There is no doubt that the above-mentioned electro-optical device 1 can be applied as a display unit of these various electronic apparatuses.

The entire disclosure of Japanese Patent Application No. 2007-200438, filed Aug. 1, 2007 is expressly incorporated by reference

What is claimed is:

1. A scan line driving circuit which selects a plurality of scan lines arranged in rows in predetermined turn and changes a logical level of the selected scan lines into an active level and which is used in an electro-optical device including a plurality of scan lines arranged in rows and grouped into a plurality of blocks, each block having p (p is an integer of two or more) rows, a plurality of data lines arranged in columns, and pixels which are disposed corresponding to intersections of the plurality of scan lines arranged in rows and the plurality of data lines arranged in columns and which become gray-scale images in response to data signals supplied to the data lines when a logical level of the scan lines becomes an active level, the scan line driving circuit comprising:

unit circuits prepared corresponding to the plurality of scan lines arranged in rows;

wherein p unit circuits of the entire unit circuits, which correspond to p rows of scan lines belonging to one block, are commonly supplied with a logical signal which becomes an active level in a period in which each of the scan lines corresponding to the p rows is selected, and wherein the unit circuit includes a first transistor having a source electrode to which the logical signal is supplied and a drain electrode connected to the corresponding scan line, a second transistor having a gate electrode to which a clock signal is supplied, a source electrode to which a select signal is supplied, and a drain electrode connected to a gate electrode of the first transistor, wherein the select signal is outputted at times synchronized with the clock signal, and a short-circuiting circuit which causes a parasitic capacitor of the first transistor to be short-circuited.

2. The scan line driving circuit according to claim 1, further comprising:

a plurality of switches which is disposed corresponding to the plurality of scan lines arranged in rows, of which one ends are connected to the corresponding scan lines, respectively, of which the other ends are commonly grounded to the non-active level, and which simultaneously turns on in a portion of a period or the entire period in which any of the plurality of scan lines arranged in rows is not selected.

3. The scan line driving circuit according to claim 1, wherein the pixels are arranged in a display domain, and the unit circuits are arranged outside the display domain.

4. The scan line driving circuit according to claim 1, wherein the pixels are separate from the unit circuits.

5. The scan line driving circuit according to claim 1, wherein a total number of unit circuits is equal to a total number of scan lines.

6. The scan line driving circuit according to claim 1, wherein the data signals supplied to the data lines are voltages corresponding to gray-scale values of the pixels.

7. The scan line driving circuit according to claim 1, wherein the clock signal is supplied in common to all the unit circuits, and different select signals are supplied to unit circuits within a same block.

8. The scan line driving circuit according to claim 1, wherein the short-circuiting circuit includes a third transistor, a fourth transistor, and a fifth transistor, wherein the third transistor has a gate electrode to which a third control signal is supplied and a source electrode connected to the active level, the fourth transistor has a gate electrode connected to a gate electrode of the first transistor, and the fifth transistor has a gate electrode connected commonly with drain electrodes of the third and fourth transistors and a drain electrode connected to the gate electrode of the first transistor, and wherein source electrodes of the fourth and fifth transistors are connected to a non-active level.

9. The scan line driving circuit according to claim 8, wherein the source electrode of the third transistor is connected to a gate-on power supply line which supplies a gate-on voltage.

10. The scan line driving circuit according to claim 8, wherein the source electrode of the third transistor is connected to the gate electrode thereof.

11. The scan line driving circuit according to claim 8, wherein the source electrodes of the fourth and fifth transistors are connected to a gate-off power supply line which supplies a gate-off voltage.

12. The scan line driving circuit according to claim 8, wherein the source electrodes of the fourth and fifth transistors are connected to the corresponding scan line.

13. An electro-optical device including a plurality of scan lines arranged in rows and grouped into a plurality of blocks, each block having p (p is an integer of two or more), a plurality of data lines arranged in columns, pixels which are disposed corresponding to intersections of the plurality of scan lines arranged in rows and the plurality of data lines arranged in columns and which become gray-scale images corresponding to data signals supplied to the data lines when a logical level of the scan lines becomes an active level, the electro-optical device comprising:

a scan line driving circuit which selects the plurality of scan lines arranged in rows in predetermined turn and changes a logical level of the selected scan lines into an active level; and a data line driving circuit which supplies data signals corresponding to the gray-scale images of the pixels corresponding to the scan line having the active-level via the data lines, wherein the scan line driving circuit includes unit circuits prepared so as to correspond to the plurality of scan lines arranged in rows, wherein p unit circuits of the entire unit circuits, which correspond to p scan lines belonging to the same block, are supplied commonly with a logical signal which becomes an active level during a period in which the scan lines corresponding to the p rows is selected, and wherein the unit circuit includes a first transistor having a source electrode to which a logical signal is supplied and a drain electrode connected to the corresponding scan line, a second transistor having a gate electrode to which a clock signal is supplied, a source electrode to which a select signal is supplied, and a drain electrode connected to a gate electrode of the first transistor, wherein the select signal is outputted at times synchronized with the clock signal, and a short-circuiting circuit which causes a parasitic capacitor of the first transistor to be short-circuited.

14. An electronic apparatus comprising the electro-optical device according to claim 13.

* * * * *